United States Patent [19]

Torres

[11] 4,174,800

[45] Nov. 20, 1979

[54] STORAGE ROLLER THRUSTER DEVICE FOR CONTINUOUS STRIP PAPER FEEDERS

[76] Inventor: Manuel M. Torres, Avda. Sancho el Fuerte, 21-80C, Pamplona, Spain

[21] Appl. No.: 867,817

[22] Filed: Jan. 9, 1978

[30] Foreign Application Priority Data

Jun. 25, 1977 [ES] Spain ..... 229.538

[51] Int. Cl.[2] ..... B65H 17/42

[52] U.S. Cl. ..... 226/113; 226/119

[58] Field of Search ..... 226/188, 118, 119, 113, 226/114; 242/58.1; 192/85 AA, 85 CA

[56] References Cited

U.S. PATENT DOCUMENTS

| | | | |
|---|---|---|---|
| 3,841,944 | 10/1974 | Harris, Jr. | 242/58.1 |
| 3,989,576 | 11/1976 | Collin et al. | 242/58.1 |
| 4,065,067 | 12/1977 | Martinez | 242/58.1 |

*Primary Examiner*—Allen N. Knowles

*Attorney, Agent, or Firm*—Eyre, Mann, Lucas & Just

[57] ABSTRACT

An improved storage roller thruster device for continuous strip paper feeders is disclosed. Abrupt motion of paper on the storage unit is obviated during initial commencement of travel whereby breakage of the paper is reduced even when the paper is of a relatively poor quality.

2 Claims, 3 Drawing Figures

STORAGE ROLLER THRUSTER DEVICE FOR CONTINUOUS STRIP PAPER FEEDERS

Paper feeders supplying the strip in a continuous process, as are used for feeding paper manufacturing machines, are arranged with a storage unit for achieving continuity in the supply during the time it takes to join an expended reel onto a new reel, and said unit is comprised of a travelling roller which, upon being displaced, pays out the paper of one turn of the actual paper being supplied, thus enabling the feed to be continued, even during those short periods of stoppage that take place while the join is being made.

Proper operation, in order to keep the feed characteristics constant in the course of the above-mentioned joining process, is accomplished by means of a particular arrangement of clutching means and adjustment in the transmission to the carrying chain belonging to said storage unit roller, but it so happens that when poor quality paper is being handled it breaks easily, and here the continuity in the feed during the joining of the reels is not generally fulfilled as required, while in any case it is necessary to reduce the paper feed speed to a minimum when joins are being made, this being due mainly due to the fact that the acceleration which the paper storage unit roller needs to have applied to it, originates from the actual pull exerted by the paper itself.

The present invention is concerned with overcoming the aforementioned difficulties, and to this end it proposes an arrangement whereby the sudden jerking of the paper on the storage unit roller is obviated at that initial moment when this latter commences its travel, and this obviously removes the main cause behind breakages occurring in the paper, so that joins between reels can be executed at high feed speeds, even when the paper being handled is of a poor quality.

Said arrangement which is the subject of this invention is essentially comprised of an inertia flywheel mounted upon an axle which rotates freely on same, and placed between two discs that are attached rotationally to said axle, where said discs are arranged in the manner of a clutch for the purpose of temporarily engaging the rotation of said flywheel to the axle under certain conditions, this being accomplished by hydraulic, pneumatic or electro-mechanical means.

All the above is such that when this arrangement is installed in conjunction with a spur wheel on the axle, or when one of the clutch discs is installed in conjunction with an axle belonging to the chain that carries the storage unit roller, and when the inertia flywheel is coupled to a machine or mechanism which will supply rotation at the same rate as the speed at which the paper is being supplied, then, if the clutch means are made to engage, the flywheel will transmit an instantaneous thrust to said storage roller, and it will make some commence its travel at a suitable speed in accordance with that of the paper supply, and if this engagement of the clutch means is made to take place in synchronism with the operation of the means employed to join the paper, then continuity will be achieved during the joining process, with no sudden jerking pull being exerted upon the paper strip, and moreover said continuity will be achieved regardless of the supply speed, so that any danger of the paper breaking is obviated, even though this be of poor quality.

It may thus be said that this arrangement which the invention covers here is of a very simple nature, and may be easily constructed and installed for its application, but where nonetheless it possesses such functional properties as to make it highly advantageous for improving and enlarging the possibilities of the paper feeders for which it is intended, insofar as it allows an increased practical use of them, with all the advantages that this implies.

In order to provide a fuller understanding of the invention, a drawing is attached hereto showing a schematic illustration of its application, but this is by no means limitative, and may therefore be subjected to those minor alterations which do not depart from the essential features thereof.

Figure 1:
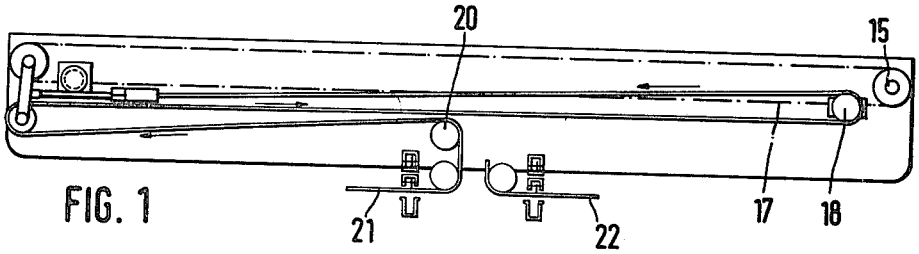
FIG. 1 illustrates that part of a paper feeder where the storage unit is incorporated for the purpose of affording a noninterrupted supply.
Figure 3:
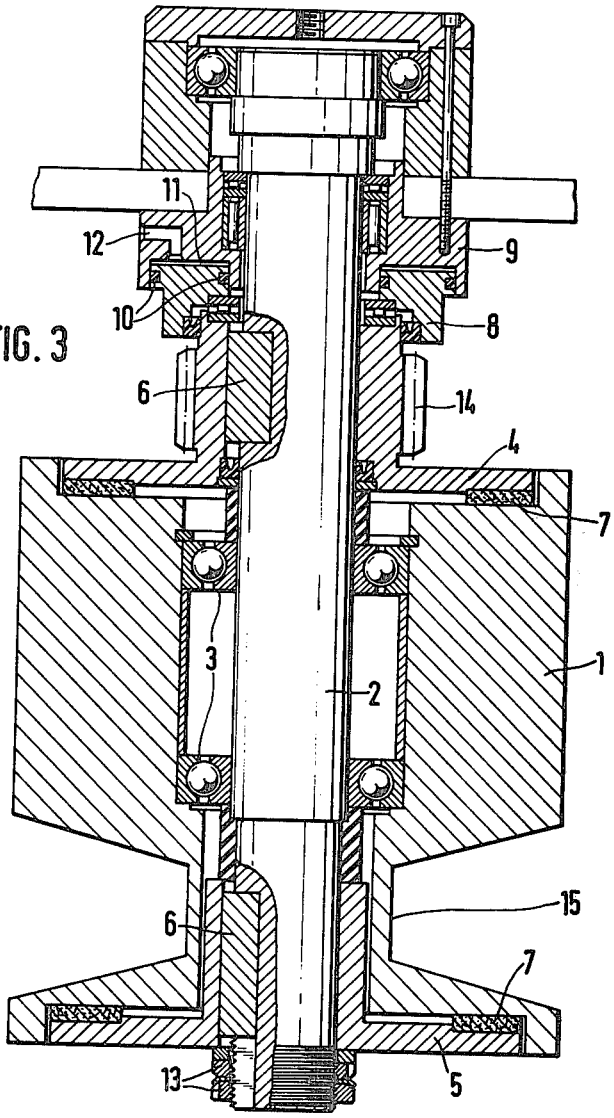
FIG. 3 is an enlarged longitudinal cross sectional view of the thrusting unit in question, and which is the subject of the invention.
Figure 2:
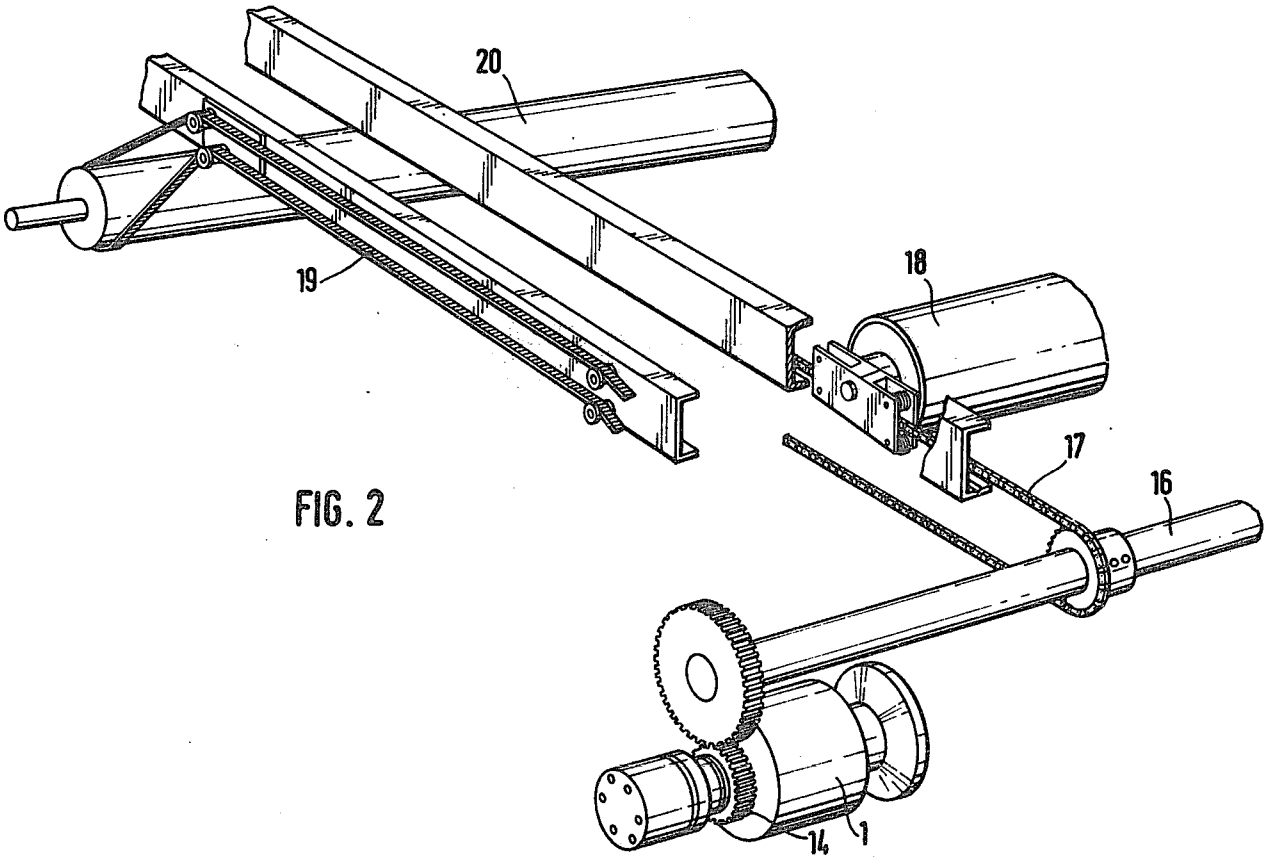
FIG. 2 is a partial detailed perspective view showing the thruster device for the storage unit roller, and the arrangement for the assembly of said device on the feeder.

The device with which the invention is concerned is comprised of an inertia flywheel (1), this being mounted on an axle (2), whereupon it can revolve freely, and for this purpose plain or roller bearings (3) are fitted, while upon this same axle (2), there are two discs (4) and (5), arranged so that they each flank one side of said flywheel (1), where said discs are attached rotationally to the axle (2) by means of suitable fitted keys or splines (6).

Said discs (4) and (5) are nonetheless arranged so as to be able to undergo certain axial travel or displacement, and the face of each which is positioned towards the flywheel (1), is fitted with friction elements (7), while the opposite side of disc (4) is in abutment with a thruster unit (8) which is housed in a body (9) having a hermetic seal (10), but arranged nevertheless in such a manner that it may undergo relative travel in the axial direction, and said body (9) defines an intermediate chamber (11), provided with a pipe (12) for fluid intake, so that upon there being a pressure applied to said chamber (11), thruster (8) is displaced and carries disc (4) up against flywheel (1), which will then and at the same time be carried up against disc (5), which latter is unable to travel further towards the free end of the axle (2), through its being prevented from doing so by suitable spacer washers or stop nut (13), in such a manner that flywheel (1) therefore becomes attached rotationally to axle (2), while it nonetheless rotates freely thereon when there is no pressure in chamber (11).

In one particular construction, disc (4) is provided with a pinion (14) integrally included therein, whilst flywheel (1) defines a peripherical groove (15) to enable it to act as a sheave.

It is then, in this manner that for the practical application to the appropriate paper feeder, that this device is assembled with pinion (14) in engagement with a drive axle (16) for the chain (17) that carries the storage unit roller (18) on the paper feeder in question, and moreover, flywheel (1) is rotationally coupled through its groove (15) and a drive belt (19), to a roller (20) which is for guiding the paper in the feeder.

If at the same time, the fluid intake (12) is connected in common or in synchronism with the fluid system used to drive paper joining and/or shearing mechanism on the feeder, then during normal operation, flywheel (1) will rotate freely upon its axle (2) at a speed dependent upon that of the paper feed, while upon the joining process being executed on paper strip (21) from an expended reel, with paper strip (22) from the new reel to replace it, flywheel (1) will become locked upon its axle (2) and its inertia will hence be transmitted through pinion (14) to axle (16) belonging to chain (17), and this will thereupon cause storage roller to be instantaneously thrusted upon its travel at a suitable speed so that the feed continues to take place under unchanged conditions, since the rotational relationship between flywheel (1) and guide roller (20) is such as to make said storage roller (18) be ejected or thrust from the commencement of its trajectory, without there being any kind of tugging in the actual paper being supplied, so that said joining process can be accomplished at high supply speeds, even when the paper is of poor quality.

In the present case, the description here is given on the basis of an actual construction of the device which is covered by the invention, but it will easily be understood that this construction may be employed in many other different ways within this same principle and subject of the invention, and hence for example, pinion (14) could equally well be incorporated in disc (5), and it could even be a separate part, and be directly mounted upon axle (2).

Moreover, in a further particular case, the relationship between the rotation of flywheel (1) and the speed of the paper supply could be accomplished without the drive belt (19), and instead a drive motor for example could be used, in conjunction with a tachometer device to detect the paper travel speed, and likewise this function could be fulfilled by means of a suitable electronic system.

In any case, and as may be seen, it is to be noted that the device covered by the invention is applicable to any paper feeder of the kind where there are one or several storage rollers incorporated for the purpose of achieving the supply of the paper strip in a continuous process.

It being considered that the above provides a sufficient description of the nature of the invention and of the way it can be constructed, it need only be added that in its assembly and component parts, changes of form, material and arrangement may be made without departing from the field of the invention, provided that such alterations do not remove the fundamental basis therefrom.

The Applicant hereby reserves the right to extend this application to foreign countries if this be possible, and in so doing, he claims the same priority as he is allowed under the present application, in accordance with International Agreements for the Protection of Industrial Property.

I claim:

1. A storage roller thruster device for continuous strip paper feeders, said storage roller being carried by a chain having at least one axle associated therewith, peculiar inasmuch that it is comprised of an inertia flywheel mounted on an axle, which is mounted in a manner that it is free to revolve with respect to its axle, and where said flywheel is positioned in between two discs equipped with friction linings on their respective faces flanking said flywheel, and which are rotationally attached to the axle, but are able nevertheless to undergo certain axial displacement, and where one of said discs is coupled on its opposite face with means which are provided for exerting a fluid pressure, and where the assembly is equipped with a pinion that is rotationally attached to the axle, all this in such a manner that there is gear engagement with an axle belonging to the chain that carries the storage roller to which the device is applied, and where the inertia flywheel is related to a means for transmitting rotation in synchronism with the speed at which the paper strip is being fed, and where, when the thruster means operate, the flywheel becomes engaged and instantaneously thrusts the paper storage roller at the same speed as that of the paper being supplied.

2. A storage roller thruster device for continuous strip paper feeders, said storage roller being carried by a chain having at least one axle associated therewith, peculiar inasmuch that it is comprised of an inertia flywheel mounted on an axle, which is mounted in a manner that it is free to revolve with respect to its axle, and where said flywheel is positioned in between two discs equipped with friction linings on their respective faces flanking said flywheel, and which are rotationally attached to the axle, but are able nevertheless to undergo certain axial displacement, and where one of said discs is coupled on its opposite face with means which are provided for exerting a fluid pressure, and where the assembly is integrally constructed in one of the said plates themselves, all this in such a manner that there is gear engagement with an axle belonging to the chain that carries the storage roller to which the device is applied, and where the inertia flywheel is related to a means for transmitting rotation in synchronism with the speed at which the paper strip is being fed, and where, when the thruster means operate, the flywheel becomes engaged and instantaneously thrusts the paper storage roller at the same speed as that of the paper being supplied.

* * * * *